United States Patent [19]

Greengrass et al.

[11] Patent Number: 4,886,372

[45] Date of Patent: Dec. 12, 1989

[54] CONTROLLED RIPENING OF PRODUCE AND FRUITS

[76] Inventors: Michael Greengrass, "Evergreen" Newton Street, Newton St. Faith, Norwich Norfolk; Anthony L. Allen, 12 Colindeep Lane, Norwich Norfolk, both of United Kingdom

[21] Appl. No.: 157,412

[22] Filed: Feb. 18, 1988

[30] Foreign Application Priority Data

Feb. 19, 1987 [GB] United Kingdom ..... 8703917
Jul. 3, 1987 [GB] United Kingdom ..... 8715756
Aug. 7, 1987 [GB] United Kingdom ..... 8718791

[51] Int. Cl.[4] ..... B65D 33/01

[52] U.S. Cl. ..... 383/100; 383/102; 383/103; 206/45.33; 229/87 F; 229/DIG. 14

[58] Field of Search ..... 383/102, 100, 103, 76; 206/436, 432, 497, 499, 557, 45.33, 45.34, 45.31; 229/87 R, 87 F, 916, DIG. 12, DIG. 14

[56] References Cited

U.S. PATENT DOCUMENTS 2,652,335 9/1953 Conti ..... 229/DIG. 14
2,664,358 12/1953 Eichler ..... 229/DIG. 12
2,689,678 9/1954 Wendt ..... 383/76
3,016,131 1/1962 Kennedy ..... 229/87 F
3,854,577 12/1974 DuMolin ..... 206/45.33
3,986,611 10/1976 Dreher ..... 206/45.33
4,012,530 3/1977 Holden ..... 206/45.33
4,503,561 3/1985 Bruno ..... 383/102
4,515,266 5/1985 Myers ..... 229/DIG. 14
4,743,123 5/1988 Legters et al. ..... 383/103

OTHER PUBLICATIONS

1987 Produce Marketing Almanac, "Controlled Atmosphere Packaging of Produce", Varriano-Marston and Wust, pp. 23-29.

*Primary Examiner*—Willis Little
*Attorney, Agent, or Firm*—Steinberg & Raskin

[57] ABSTRACT

A flexible, semi-rigid or rigid plastics material container, bag or encasement for produce, the container, bag or encasement having a selected size and number of openings therein, with the modified atmosphere within the container, bag or encasement controlled to delay the ripening of the produce located within the container, bag or encasement.

6 Claims, 6 Drawing Sheets

FIG. 9
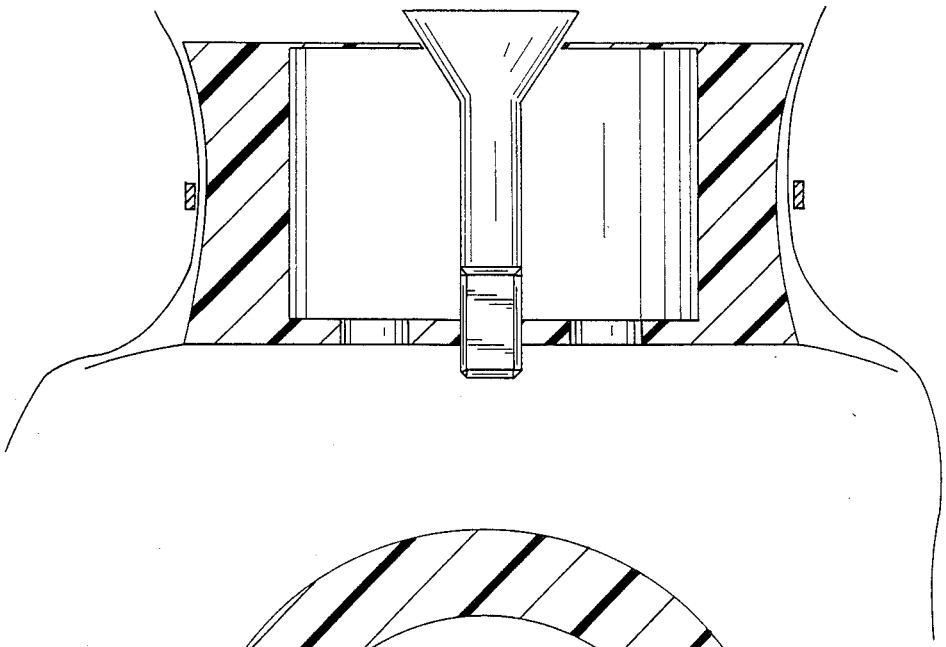
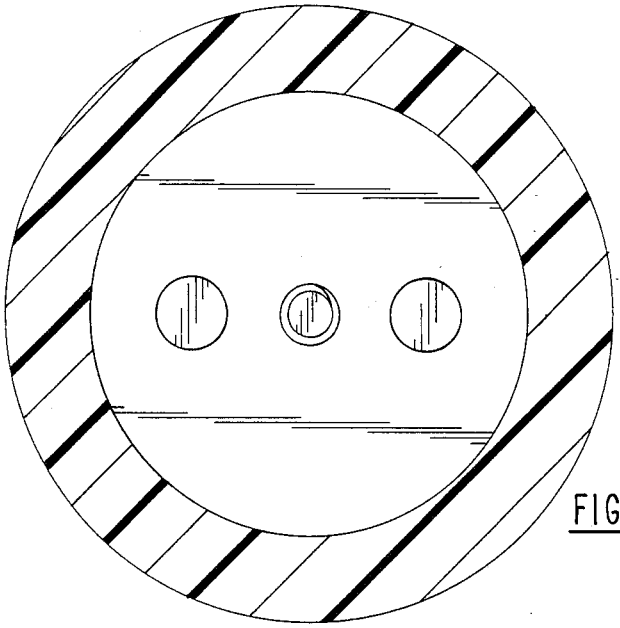
FIG. 10

CONTROLLED RIPENING OF PRODUCE AND FRUITS

BACKGROUND OF THE INVENTION

The present invention concerns improvements in or relating to the controlled ripening of produce and fruits, etc. More particularly, the present invention is concerned with plastics material containers or bags, both rigid and flexible, for encasing fresh produce and fruits.

There are various known procedures available for the packaging of produce. However, such procedures do not effectively control the ripening of produce and fruits without damage to the produce and fruits.

The present invention seeks to provide a container or bag which enables the internal atmosphere to be modified as desired and thereby eliminate the problems associated with produce packed in a totally sealed package where over-modification of internal atmospheres occurs.

In relation to the provision of a container or bag in accordance with the present invention one must firstly consider the various problems associated in the packaging of produce. Firstly, live produce such as fruit and vegetables, unlike dead material such as meats, have respiration in that they absorb oxygen and give off carbon dioxide. When covered with a film, the atmosphere within the packing or wrapping changes. Most thin films are permeable, but even thin gauge stretch polyvinylchloride is not sufficiently so to cope with most live products. The change that takes place within the packs is called modified atmosphere (MA).

When the levels of carbon dioxide within the pack has reached over five percent and the oxygen in the pack has been lowered to eight percent, the internal atmosphere within the pack has modified to an extent where the process of ripening of the produce or fruits has been significantly slowed.

If the levels of oxygen within the pack are allowed to reduce below four percent and the levels of carbon dioxide increase above six percent, then permanent damage to the produce or fruits will occur.

There will be off odours (alcoholic) present in the pack, the product will have a bitter, and musty taste and its ripening permanently suspended.

SUMMARY OF THE INVENTION

It is an object of the present invention to provide a container or bag which is designed to obtain a delay in ripening of the produce or fruits by allowing the produce or fruits to modify the internal atmosphere of the pack but not allowing the oxygen levels to fall and the carbon dioxide levels to rise to such levels as to cause damage to the produce and fruits.

According to the present invention there is provided a flexible, semi-rigid or rigid plastics material container, bag or encasement for produce, said container, bag or encasement having a selected size and number of openings therein, whereby the modified atmosphere within the container, bag or encasement is controlled, thereby allowing the ripening of the produce, when located within the container, bag or encasement, to be delayed. The number and size of said openings are dependent upon various parameters, such as the produce concerned, its variety and weight per pack and the temperature at which the produce is required to be stored or transported, as these factors will have direct bearings upon the respiration of said produce. The number of openings and the size may be calculated by scientific testing when details of the product variety, produce/-pack weight and temperatures are known.

It is possible that, for retain packs containing as little as 500 grams of produce, a single micro perforation opening as small as 0.25 mm in diameter per pack may be all that is required to delay ripening.

In the case of bulk containers containing hundreds of kilograms of produce, several holes as large as 25 mm may be required.

By the term 'micro perforation', it is to be understood the process of removing extremely small amounts of film to leave very small holes, the holes being large enough to permit passage of gases and moisture therethrough, but being too small to permit ingress of dirt, etc.

It is to be understood that micro perforation is not to be confused with mere puncturing of a film. Mere puncturing generally leads, in all cases, to the film closing in again after puncturing which gives, at best, a very variable performance.

While the opening(s) can be provided in the body of the container, bag or encasement, in an embodiment of the invention the opening(s) is provided in the neck region of the container, bag or encasement. In such embodiment which is particularly suitable for bulk packaging of produce, it is preferable for dial means to be associated with the neck region of the container, bag or encasement. Such arrangement enables a dialable size of opening(s) to be selected, which means the modified atmosphere within the container, bag or encasement can be variably controlled, thus enabling the same container, bag or encasement to be used for different produce or varieties and/or various temperature requirements, the particular size of opening(s) being indicated, suitably by the utilization of different colours or numbers on the dial means.

The total volume of the opening(s) is critical for each particular product/temperature. If one were to provide excess openings, suitably in the form of micro perforations over the container, bag or encasement, then the desired modified atmosphere within the container, bag or encasement will not be achieved.

If insufficient opening(s) were provided in the container, bag or encasement, then the enclosed product would overmodify the internal atmosphere of the pack to cause irreparable damage to the produce contained therein.

In accordance with an embodiment of the invention, there is provided a plastics material stretch film which has been micro perforated, the number and size of said micro perforations being selected for the particular product to be packaged therein, to produce a controlled modified atmosphere.

It is preferable with the small number of openings necessary in the majority of retail packs, that they should be placed in such positions in said packs as to eliminate the possibility of product within the packs blocking the micro perforations or openings, thus reducing or totally destroying the performance of said packs.

In one known procedure, stretch film is used in the packaging of fresh produce. However, problems occur in relation to insufficient film permeability causing undue condensation. For example, very high respiration products such as mushrooms, when packed in a film overwrapped punnet, do have very heavy pack condensation problems. For this and other reasons, the film is generally spiked in an attempt to ventilate the product. While such action will generally cure the problem of condensation due to its relatively crude nature, other problems occur such as dehydration and subsequent weight loss and reduction of visual appeal to the potential customer. When micro perforation pattern, utilizing the arrangement no. of lines/distance lines apart (mm)/pitch of pins (mm)/size of holes (mm) 05/20/30/60 was used on PVC stretch film overwrapped punnets, not only was the weight loss of the mushrooms significantly reduced, the mushrooms would keep for periods of up to six days longer than spiked packs before going brown.

Another interesting case is that of packaging iceberg lettuce. Severe weight loss by dehydration has been observed when such lettuce are wrapped in large holed perforated polypropylene. On the other hand, high amounts of condensation have been noted when the product has been packed in plain PVC stretch film. This was the basis, some years ago of the theory that iceberg lettuce was going prematurely brown when wrapped in PVC film; however, it was not the film causing the problem at all but the trapped condensation. Tests carried out using micro perforated stretch film micro perforated to pattern 11/25/50/60 gave up to seven extra days life to the lettuce compared with the larger holed polypropylene wrapping.

Sweetcorn is one of the highest respiration products known and not to wrap or pack causes high dehydration and weight loss. By packing in a tray and overwrapping the tray with PVC stretch film micro perforated to 05/20/30/60, even with the sweetcorn modifying the internal atmosphere of the pack very quickly, the micro perforation allowed a slowing of the ripening with less weight loss than previously experienced. When packed in plain PVC film overwrapped packs, the sweetcorn overmodified the internal atmosphere of the pack within 60 minutes causing very unpleasant odours (alcoholic) to occur and the product was totally uneatable.

If the packaging is given too much ventilation, as with ventilated polyethylene bags, net sacks, perforated snap on plastic lids and too highly perforated polypropylene film, etc., problems with weight loss due to dehydration will occur. Some products can lose a great proportion of their weight through dehydration. As previously mentioned mushrooms are a case in point. Brussel sprouts too are a problem product, but weight loss does apply to all produce and fruits.

In an attempt to indicate further advantages achieved by utilizing films in accordance with the present invention, tests were carried out on brussel sprouts. In this connection a standard net bag was compared with a plastic punnet overwrapped with PVC stretch film micro perforated to pattern 11/25/50/60. The results obtained are as follows.

| Micro perforated punnet pack | | net bag |
|---|---|---|
| Weight loss after one week | 1% | 13% |
| Weight loss after two weeks | 2% | 30% |

It will thus be seen that if a net pack were utilized then one must allow for a minimum of 13% extra product per bag to overcome weight loss. Furthermore, the product suffers from a very rapid deterioration and after only a few days it is almost in an unsaleable state.

By using micro perforated film wrapped punnets, extended sell-by dates can be obtained reducing problems of supply in bad weather and reducing waste by retailers having excess product on the shelves in an unsaleable condition.

In the case of washed baby parsnips, further problems arise in that they turn prematurely brown if exposed to too much oxygen, at temperatures above ten degrees centigrade. Covering the pack with plain PVC stretch film will not be the answer; it will stop the product going prematurely brown by keeping out the majority of the oxygen, but the resulting over modification of the internal atmosphere will render the product unsaleable due to off odours (alcoholic) and bitter tastes. By covering the pack with PVC stretch film micro perforated 01/00/50/20 pattern, the baby parsnips did not go brown and the internal atmosphere of the pack did not overmodify.

The plastic stretch film in accordance with an embodiment of the present invention, having micro perforations therein, attempts to overcome the problems referred to above. The film should include the correct number of micro perforations involved in packaging produce, to suit each particular product and temperature.

Micro perforated PVC stretch films have been machine applied, even when put under more the normal tensions and the pack necking and in consequence, the film remained intact.

Utilizing the arrangement number of lines/distance of lines apart (mm)/pitch of pins (mm)/size of hole (mm), the following in PVC stretch film has been found to be suitable:

| |
|---|
| 11/25/50/60 |
| 05/20/30/60 |
| 01/00/50/20 |
| 03/25/50/20 |

In use the containers, bags or encasements may be micro perforated either before or after, the produce is located therein.

The number of lines of micro perforations, the pitch of pins (mm) required to produce said perforations, the size of holes produced and the distance of lines apart can be selected as desired.

In an embodiment of the invention, there is provided micro perforated material in reel form which is formed into containers by a packing machine. It is also possible to apply the micro perforations during or after the container or bag has been formed, suitably by utilization of a roller having pins or shaped discs on the outer surface thereof, either heated or not.

The invention is also applicable to plastic resealable containers for use in both commercial and domestic situations where micro perforations of either a permanent nature or a dialable system for different products could be utilized. Thus, in one arrangement, the resealable container could be utilized for storing various types of fresh produce, for example in a refrigerator. Moreover, the number of micro perforations requires would depend upon the product located within the container. Accordingly, in a further embodiment of the invention, means are provided whereby the number of micro perforations in the container may be varied as desired, depending upon the nature of the produce being stored within the container. A suitable form of dial means could be provided to indicate to the user the number of micro perforations to be exposed.

The present invention can be utilized for particular weights of product from a few grams to one ton pallets of product and above.

In accordance with one aspect of the present invention, the containers may be designed to permit trays, baskets or bags of product to be stacked within a cover and the top totally sealed with heat sealing means or by any other suitable method.

In accordance with the present invention, exchange of gases is only allowed through a precise number of micro perforations in the container. Different produce, storage temperature and quantity of product will influence the exact number and size of micro perforations in each container.

While any accidental damage to containers in accordance with the invention can be quickly and satisfactorily sealed with moisture-proof self adhesive tape, care must be taken not to tape over any micro perforations as this will seriously affect the performance of the container.

Containers in accordance with the invention can be made in an infinite number of sizes from the smallest retail pack to large bulk containers containing tons of product.

For example, a container can be provided which will be suitable for a complete pallet load, 48"×48", stacked six trays high. In such instance, the container will be placed upon a pallet and the trays or baskets containing the product are stacked inside. The top of the container is then heat sealed to make such container completely airtight except for the micro perforations.

The correct number of micro perforations in the container will allow the product inside to be transported or stored over long periods by slowing down the ripening to a selected extent. For example, ripening of tomatoes can be delayed by up to one week at 20° C., cauliflower 4 weeks at 1° C.

Respiration of product can be delayed by reducing the temperature while making certain such temperature is not reduced below a level where the product can be damaged. This will mean that there will be less micro perforations than for the same amount of product stored at a higher temperature. By reducing respiration and the number of micro perforations per container, ripening will be retarded even further.

The present invention is particularly suitable for the handling of tomatoes, both homeproduced and foreign. In the latter case, foreign tomatoes can be transported by ship rather than expensive air freight.

Containers in accordance with the present invention are believed to be beneficial for all produce including fruits, vegetables and other fresh produce.

BRIEF DESCRIPTION OF THE DRAWINGS

The present invention will be further illustrated with reference to the accompanying drawings in which various containers in accordance with the present invention are shown in schematic form.

In the drawings,

FIG. 9 is a side elevational view of an alternative embodiment in accordance with the present invention; and FIG. 10 is a top view of the embodiment illustrated in FIG. 9.

DESCRIPTION OF THE PREFERRED EMBODIMENTS

Figure 1:
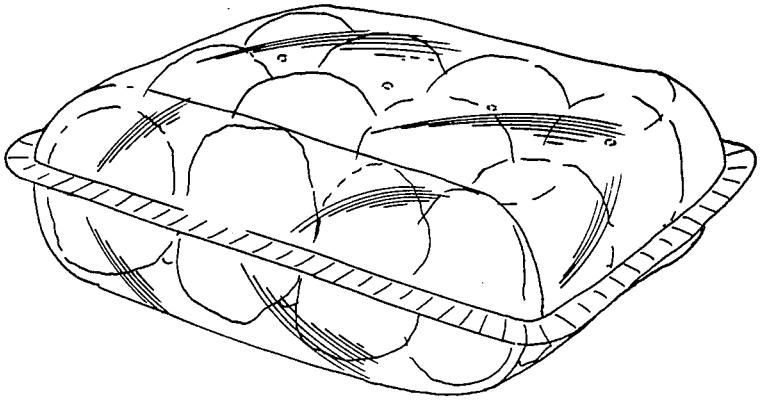
FIGS. 1 and 2 are perspective views of embodiments in accordance with the present invention.

FIG. 1 illustrates a flow pack such as would be produced upon a horizontal form machine made totally from semi-rigid or flexible film on one reel fed into a machine and formed, filled and sealed along three sides.

Figure 1A:
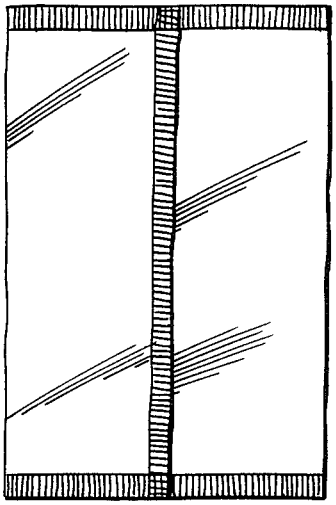
FIGS. 1A and 1B are side views of embodiments in accordance with the present invention.
Figure 1B:
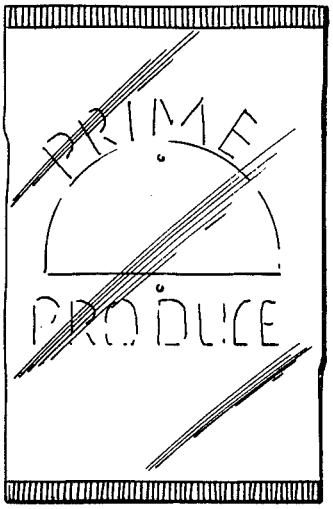

FIGS. 1A and 1B show a container which is produced by a vertical form machine, wherein the product is placed in a 'bag' or container made by the packing machine from a reel of flexible film and sealed along one side and top and bottom of pack.

Figure 2:
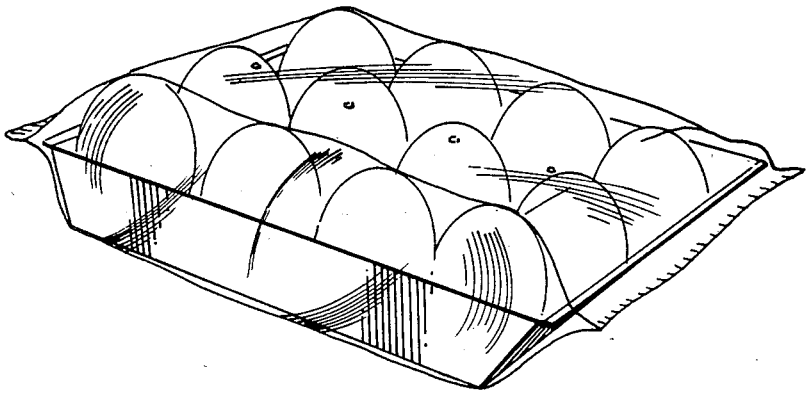

FIG. 2 shows a container wherein the product is placed in a small shallow tray and the machine forms one reel of film around the pack to give the same effect as the container of FIG. 1. However, the FIG. 2 arrangement results in a more rigid pack being obtained and film of thinner gauge can be used.

The film in each case is supplied with the precise number of micro perforations to give each pack and/or product the required atmosphere for delayed ripening.

In each case shown it may be required to hold the product/pack at a low temperature of e.g., eight degrees centigrade while it is stored and being transported. When the pack is displayed it will be at a temperature somewhat higher, e.g., twenty degrees centigrade. In this case extra micro perforations would be placed in the reel of film and covered with a self adhesive tape, tab or label; these would remain covered until the product/pack was put on display at the higher temperature when the tape, tab or label would be removed to allow the extra gas exchange required by the products increased respiration.

Figure 3:
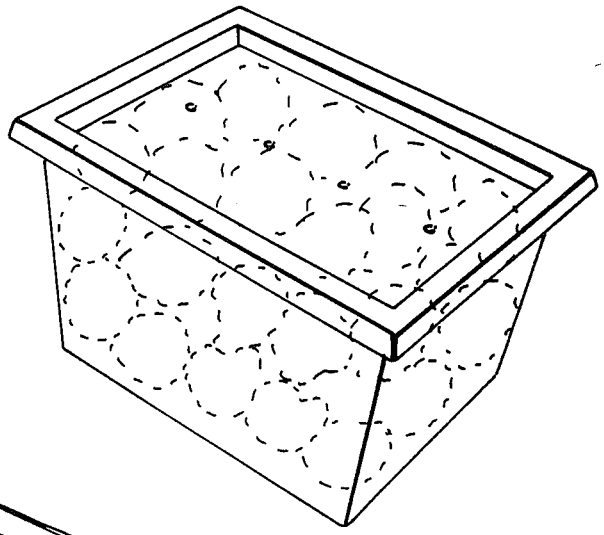
FIGS. 3, 4A, 4B, and 5 are also perspective views of embodiments in accordance with the present invention.

FIG. 3 illustrates a plastic punnet having a close fitting plastic lid with micro perforations in the lid. It is also possible to have micro perforations in the side of the container but this would give at best variable results as the produce may block certain of the holes.

Figure 4A:
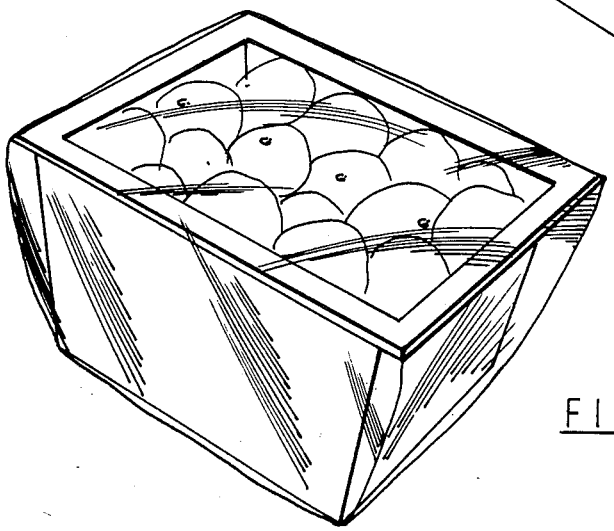
Figure 4B:
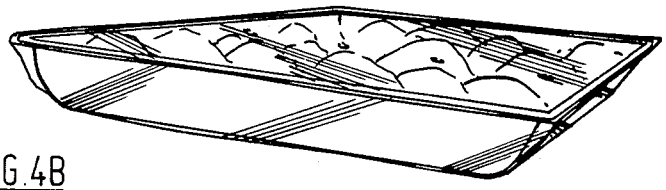

FIG. 4A shows a plastic punnet and FIG. 4B a deep tray formed of expanded polystyrene, being totally overwrapped with stretch film. In each case the film is micro perforated.

Figure 5:
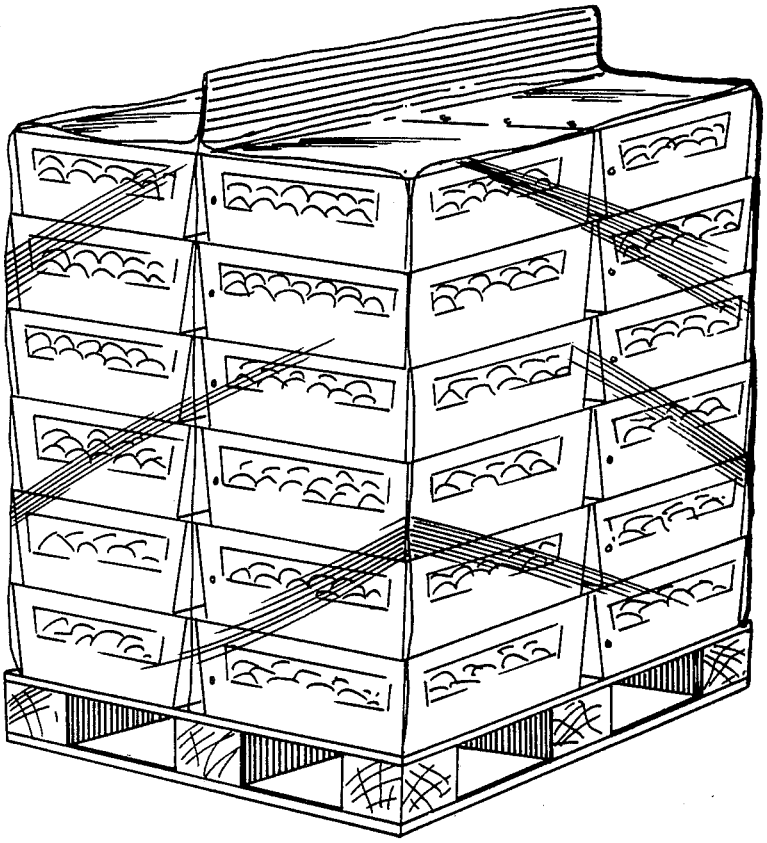
Figure 6:
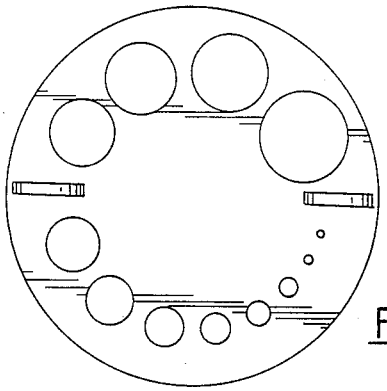
FIG. 6 is a top view of a component forming a part of one embodiment in accordance with the present invention.
Figure 7:
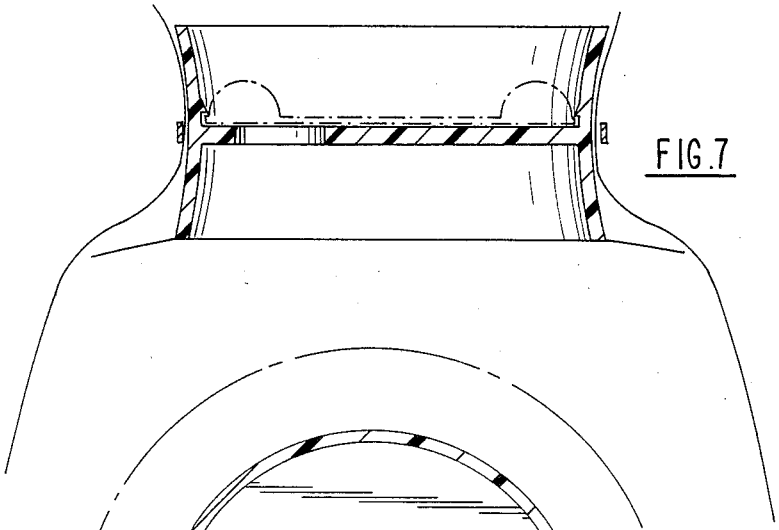
FIG. 7 is a side elevational view of the embodiment utilizing the component of FIG. 6.
Figure 8:
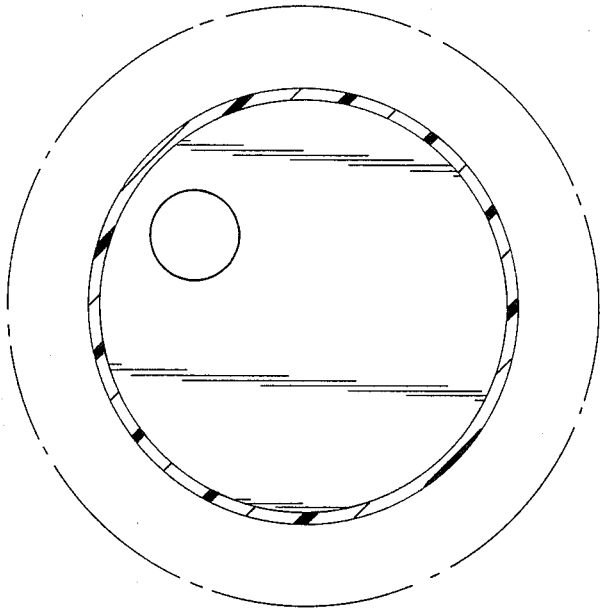
FIG. 8 is a top view of the embodiment illustrated in FIG. 7.

FIG. 5 shows a large polyethylene box bag containing a number of trays of produce. Micro perforations are provided as illustrated in the side and top which control the internal atmosphere. The box bag stands upon a standard 48 inch×48 inch pallet.

It is possible to use half and quarter size box bags particularly for produce which is required to be used, packed or sold in smaller quantities than full pallet lots. It is thus believed that the present invention provides a new arrangement for the encasement of fresh produce to delay the ripening thereof.

It is also within the scope of the present invention to replace the micro perforations by one, two or more larger holes, the surface area of such larger hole(s)

being the same as the total surface area of the micro perforations to be replaced. It is to be understood that the number of larger holes will depend upon details of the produce, its variety and the temperature as in the case of micro perforations.

Also according to an embodiment of the present invention, there is provided a micro perforated plastics material bag, sack or pack. When such bag, sack or pack is placed over fresh produce located upon a pallet, then the atmosphere within the bag, sack or pack can be controlled as desired, thereby keeping deterioration to a minimum.

In use, the bags, sacks or packs can be micro perforated either before or after being applied to the product covered on the pallet.

Depending upon the nature of the material to be packed and the various parameters considered which will affect deterioration of the product, a suitably micro perforated bag, sack or pack would be applied over the produce located on the pallet. If desired the open end of the bag can be sealed by appropriate shrink wrapping of the end region of the bag, sack or pack.

To enclose a pallet sized area of produce trays with an encasement will provide means to allow the produce or fruits to successfully modify the internal atmosphere to retard the ripening of said produce or fruit.

A large sheet of suitably heavy gauge plastic material, preferably polyethylene, is first placed upon the pallet. Produce trays are stacked two high on top of the plastics sheet. The sheet is then turned up on all four sides and the edges are captured by the next row of produce trays being stacked upon it, trapping it in place.

When the pallet has been stacked with produce trays to the desired height, a large flat plastics sheet of suitably heavy duty plastic is placed over the top of the pallet. This sheet will contain dialable device(s). This plastic sheet is turned down each side of the pallet and sealed by various means to the first sheet placed originally upon the pallet. The preferred method is to use suitably wide self adhesive waterproof tape.

The pallet pack can now be secured either by heat shrinking the plastic cover or by the addition of stretch wrapping the sides of the pallet to secure the load.

When this has been completed the dial(s) can be set to the appropriate aperture depending upon product/variety, weight and temperature. The top flat sheet containing the dialable device(s) could be substituted with a pallet cover also containing dialable device(s) and sealed in a similar way to the bottom sheet as previously described.

The invention also contemplates the use of foil coated or plastic metalized bags, sacks or packs for use in locations of high temperature where the relective material would reduce if not eliminate the greenhouse effect of the containers by reflecting over ninety percent of the suns rays.

It is also possible to utilize perforated containers to suit very high respiration conditions and to reduce the number and or size of the openings when the packaged produce is subjected to much lower temperatures e.g. in cold rooms or stores, by covering certain of the holes with suitable material, e.g. self adhesive waterproof tape. In the reverse situation a tear-off tab or tape could be utilized.

The use of micro perforations and openings lends itself to vacuum cooling techniques to facilitate rapid cooling by allowing evacuation of internal atmosphere.

It is also possible to utilize a perforated film wherein, when the temperature increases the size of the openings increase, and when the temperture falls the size of the openings reduce. The difference, while only a small amount, can be sufficient to maintain the desired modified atmosphere within the container.

It is also an embodiment to use an automatic device which activates a tapered rod within an insert to increase the opening to the encasement as the temperture increases, by using an expanding rod (FIGS. 9 and 10). This can have a fine adjustment by use of the following;

a. materials with varying expansion rates, and b. a fine screw adjustment

This achieves precise increase in gas exchange in direct proportion to the temperature rise/size of container/-weight/variety of produce.

A further embodiment is the use of specially shaped pins set at precise angles to achieve the desired micro perforation of stretch film.

We claim:

1. A flexible, semi-rigid or rigid plastics material container, bag or encasement for produce, said container, bag or encasement having a selected size and number of at least one opening therein for controlling modified atmosphere within the container, bag or encasement and thereby delaying ripening of the produce, when located within the container, bag or encasement.

wherein the container, bag or encasement comprises a body region and a neck region, and the at least one opening is provided in such neck region, wherein dial means are associated with the neck region of the container, bag or encasement, whereby a dialable size of said at least one opening may be selected, and the modified atmosphere within the container, bag or encasement can be variably controlled, thus enabling the same container, bag or encasement to be used for different product or a variety of products or for various temperature requirements.

2. A container, bag or encasement as recited in claim 1, wherein the particular size of said at least one opening is indicated by different colours or numbers on the dial means.

3. A microperforated stretch film, the number and size of said microperforation being selected for the particular product to be packaged therein, to produce a controlled modified atmosphere, wherein the arrangement number of lines/distance lines apart (mm)/pitch of pins (mm)/size of holes (mm) utilized is selected from the group consisting of:

11/25/50/60,

05/20/30/60,

01/00/50/20, and

03/25/50/20.

4. A stretch film as recited in claim 3, formed of polyvinyl chloride (PVC).

5. A flexible, semi-rigid or rigid plastics material container, bag or encasement for produce, said container bag or encasement having a selected size and number of at least one opening therein for controlling modified atmosphere within the container, bag or encasement and thereby delaying ripening of the produce, when located within the container, bag or encasement.

wherein the container, bag or encasement is provided with one or more holes, wherein (a) at least one of number and size of the hole or holes is reduced by application of self adhesive waterproof tape, or (b) the number is increased by provision of a tear-off tab or tape.

6. A flexible, semi-rigid or rigid plastics material container, bag or encasement for produce, said container, bag or encasement having a selected size and number of at least one opening therein for controlling modified atmosphere within the container, bag or encasement and thereby delaying the ripening of the produce, when located within the container, bag or encasement, additionally comprising a tapered rod with an insert for placement in said at least one opening, said tapered rod increasing size of said at least one opening by directionally expanding with increasing temperature.

* * * * *